US009993709B2

(12) United States Patent
Akin et al.

(10) Patent No.: US 9,993,709 B2
(45) Date of Patent: Jun. 12, 2018

(54) WRIST POSITIONING TRAINING AID

(71) Applicant: Re-Peat Sports, LLC, Pleasant Hill, MO (US)

(72) Inventors: Tim Akin, Pleasant Hill, MO (US); Matthew W. Mitchell, Harrisonville, MO (US)

(73) Assignee: RE-PEAT SPORTS, LLC, Pleasant Hill, MO (US)

( * ) Notice: Subject to any disclaimer, the term of this patent is extended or adjusted under 35 U.S.C. 154(b) by 0 days. days.

(21) Appl. No.: 15/418,471

(22) Filed: Jan. 27, 2017

(65) Prior Publication Data

US 2017/0216696 A1 Aug. 3, 2017

Related U.S. Application Data

(60) Provisional application No. 62/288,326, filed on Jan. 28, 2016.

(51) Int. Cl.
*A63B 69/00* (2006.01)

(52) U.S. Cl.
CPC .. *A63B 69/0059* (2013.01); *A63B 2208/0204* (2013.01)

(58) Field of Classification Search
USPC ..... 473/207, 212–217, 438, 450, 451, 458, 473/464
See application file for complete search history.

(56) References Cited

U.S. PATENT DOCUMENTS

| | | | | |
|---|---|---|---|---|
| 4,615,185 | A * | 10/1986 | Bollinger | A44C 5/0053 224/164 |
| 4,747,779 | A * | 5/1988 | Gerstung | A63B 21/0004 128/882 |
| 5,005,833 | A | 4/1991 | Groveman et al. | |
| 5,601,285 | A | 2/1997 | Baxter, III | |
| 6,006,358 | A | 12/1999 | Keating | |
| 6,537,160 | B2 * | 3/2003 | Chrystal | A63B 69/0059 473/213 |
| 6,846,254 | B2 | 1/2005 | Baxter | |
| 8,052,546 | B1 | 11/2011 | Nagel et al. | |
| D652,882 | S * | 1/2012 | Nagel | D21/781 |
| 2015/0011338 | A1 * | 1/2015 | Russotti | A63B 69/00 473/422 |
| 2016/0183626 | A1 * | 6/2016 | Kalina | A43B 5/00 36/114 |

* cited by examiner

*Primary Examiner* — Nini Legesse
(74) *Attorney, Agent, or Firm* — Husch Blackwell LLP

(57) ABSTRACT

An athletic training device for selectively and removably urging a user's limbs together is provided. The device includes two arm/leg cuffs, each having a flexible band with securing means for removably securing the band to a user's limb. Extending from each band is a spacer component having a sidewall and a top wall. Located on or within the top wall is a magnet. The magnets in each cuff are configured with opposing polarity so that the top walls of each cuff are urged together when placed in close proximity to one another. The device can be used by securing each cuff around a user's arms/legs. When the user places his/her arms/legs in close proximity to one another, the magnets urge the cuffs in an attached arrangement and the user can only separate his/her arms/legs by intentionally applying a separating force sufficient to overcome the force of the magnets.

14 Claims, 15 Drawing Sheets

WRIST POSITIONING TRAINING AID

CROSS-REFERENCE TO RELATED APPLICATIONS

This Application claims priority to U.S. Provisional Patent Application Ser. No. 62/288,326, filed on Jan. 28, 2016, to Tim Akin et al., entitled "Wrist Positioning Training Aid," the entire disclosure of which is incorporated herein by reference.

BACKGROUND OF THE INVENTION

The present invention relates generally to devices for maintaining a desired positioning of objects through magnetic forces, including but not limited to a user's arms, hands or limbs. The present invention also generally relates to training and/or support aids for sporting activities, including baseball, softball, football, basketball, golf and the like. In particular, the present invention can relate to a baseball/softball training device for assisting a user in the proper hand positioning while catching a ball or fielding a ground ball.

When catching a baseball or softball, coaches teach players to use both hands and catch the ball with their throwing hand next to their glove. Similarly, when fielding a ground ball in baseball and softball, coaches teach players to place their throwing hand just above the open glove in order to assist in fielding the ball and reduce the amount of time it takes to field, transfer and throw the ball. However, some players, especially younger players, have an instinctive tendency to position their throwing hand away from their glove when catching a ball or fielding a ground ball. In recognition of this problem, coaches and trainers have used devices such as that disclosed in U.S. Pat. No. 5,601,285, that require players to position their hands near one another. However, the device disclosed in U.S. Pat. No. 5,601,285 and similar devices do not allow for the player to separate their hands after catching of fielding the ball and must be repositioned between each repetition. As a result, these devices cannot be effectively and efficiently used. Accordingly, a need exists for a device that can maintain a user's hands in a desired position and allow the user to effectively and efficiently separate and reposition their hands in the desired position.

BRIEF SUMMARY OF THE INVENTION

The present invention is directed to a training system or device for training and assisting user's to maintain proper hand, foot, arm or leg positioning relating to certain athletic activities, such as catching or fielding a ball or swinging a bat, club or the like. In particular, the device can be used to assist a user in training and assisting in proper fielding position for baseball player when fielding a groundball by preventing the user from inadvertently separating the user's throwing hand from the user's glove hand.

The device can include a pair of cuffs that can be removably attached to the user's wrists, arms, ankles, or legs. Each cuff can include a flexible band, a spacer component attached to the band and a magnet positioned on the spacer component. The flexible band can be constructed from a flexible material and can be configured for being secured around the user's arms, wrists, legs or ankles. The flexible band can further include securing means for enclosing the band around the user's limbs. According to one particular embodiment, the securing means can comprise a plurality of notches on one end of the band and a slot on the opposing end of the band to allow the first end to be inserted through the slot on the second end and retained along one of the notches at the size desired by the user.

The spacer component can be connected to the flexible band near the central region of the band and can include a top wall segment that remains spaced apart from the flexible band. The spacer component can further include a sidewall extending between the top wall segment and the flexible band and an opening in the sidewall to allow access to the interior of the spacer component. One function of the spacer component is to provide sufficient separation between the user's wrists, arms, legs, etc. that is commonly required when performing a particular sporting maneuver, such as fielding a groundball in baseball.

The magnet can be positioned on or in the top wall segment of the spacer component and can be constructed as any type of suitable magnet According to one embodiment, the magnet is positioned within a pocket defined into the interior side of the top wall segment. Additionally, the pocket can include an opening having a diameter slightly smaller than the diameter of the magnet that allows the magnet to be secured within the pocket but be removable from the pocket if desired by the user. The magnet in each cuff can be specifically polarized and orientated so that when the user positions his or her wrists, arms, legs, etc. close together, the magnetic force between the two magnets urges the cuffs together and prevents separation of the cuffs (and the user's wrists, arms, legs, etc.) unless a sufficient separating force is applied by the user.

According to an alternative embodiment, each cuff can be configured with a flexible band having a magnet positioned on or in the central region of the band and a spacer component configured for keeping the central region of the band and the magnet spaced apart from the user's arm, wrist, leg or ankle. According to this embodiment, the flexible band has a plurality of notches defined along both ends of the band and the spacer component is configured as an elongated flexible plate with slots defined through each end. The slots can be sized and configured for receiving one end of the flexible band and for being selectively retained by the plurality of notches. The spacer component effectively divides the cuff into a first section and a second section, where the first section can be secured around the user's wrist (or other portion of the user's arm or leg) and the second section extends away from the user's wrist and keeps the central portion of the band and the magnet spaced apart from the user's wrist.

The training device can be used by securing each cuff to the user's wrist (or other desired location). Once secured, when the user positions his or her hands in close proximity to one another, the magnets urge the cuffs together. In addition, the magnetic force created by the magnets in the cuffs keeps the cuffs connected together and prevents the user from inadvertently separating the user's hands into an improper position.

Other aspects and advantages of the present invention will be apparent from the following detailed description of the preferred embodiments and the accompanying drawings figures.

DESCRIPTION OF THE SEVERAL VIEWS OF THE DRAWING

In the accompanying drawing, which forms a part of the specification and is to be read in conjunction therewith in which like reference numerals are used to indicate like or similar parts in the various views.

DETAILED DESCRIPTION OF THE INVENTION

Figure 1:
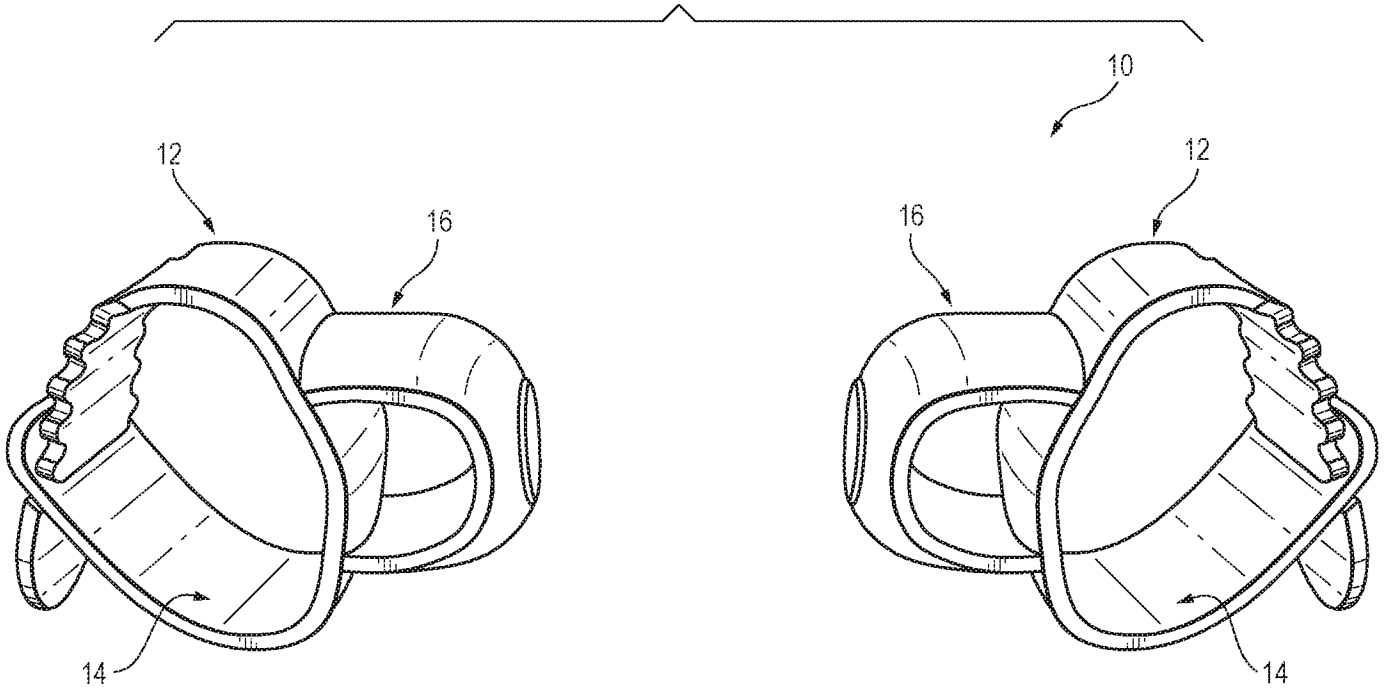
FIG. 1 a perspective view of an athletic training device having two attractable wrist cuffs in a separated position in accordance with one embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

As illustrated in the several figures, the present invention is directed generally to a training system or device 10 configured for training and/or assisting a user in maintaining proper athletic positioning by urging the user's limbs in close proximity to one another. According to one specific embodiment, and as described in greater detail herein, device 10 can be used as a training aid for training/assisting a user in properly fielding a ground ball in baseball or softball by selectively urging the user's wrists and hands in proper position and retraining the user from inadvertently separating his or her hands into an improper position. Device 10 can also be used as a training mechanism for many other different sports and athletic activities in order to train and assist in the proper positioning for certain athletic maneuvers, such as but not limited to maintaining a user's arms and hands in proper position when catching, receiving or shooting a football, basketball, baseball, etc., or when swinging a golf club, hockey stick, baseball bat, etc., or to maintain the user's legs and/or feet in close proximity for certain athletic maneuvers. It is also recognized that, while several embodiments of the present invention described herein are directed toward sports and athletic training activities, device 10 can also be advantageously used for several other purposes where it is optimal to selectively maintain a user's arms, hands or limbs in close proximity to one another in a selectively removable manner, or even to hold various objects together.

Figure 2:
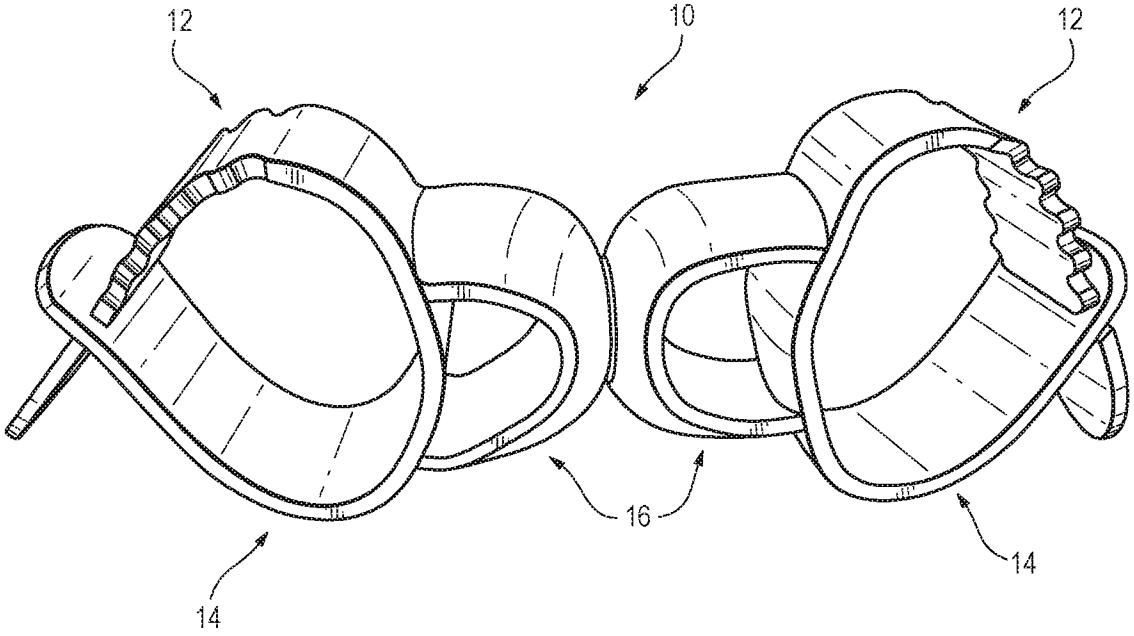
FIG. 2 is a perspective view of the device of FIG. 1 illustrating the two attractable wrist cuffs in an attached position in accordance with one embodiment of the present invention.
Figure 3:
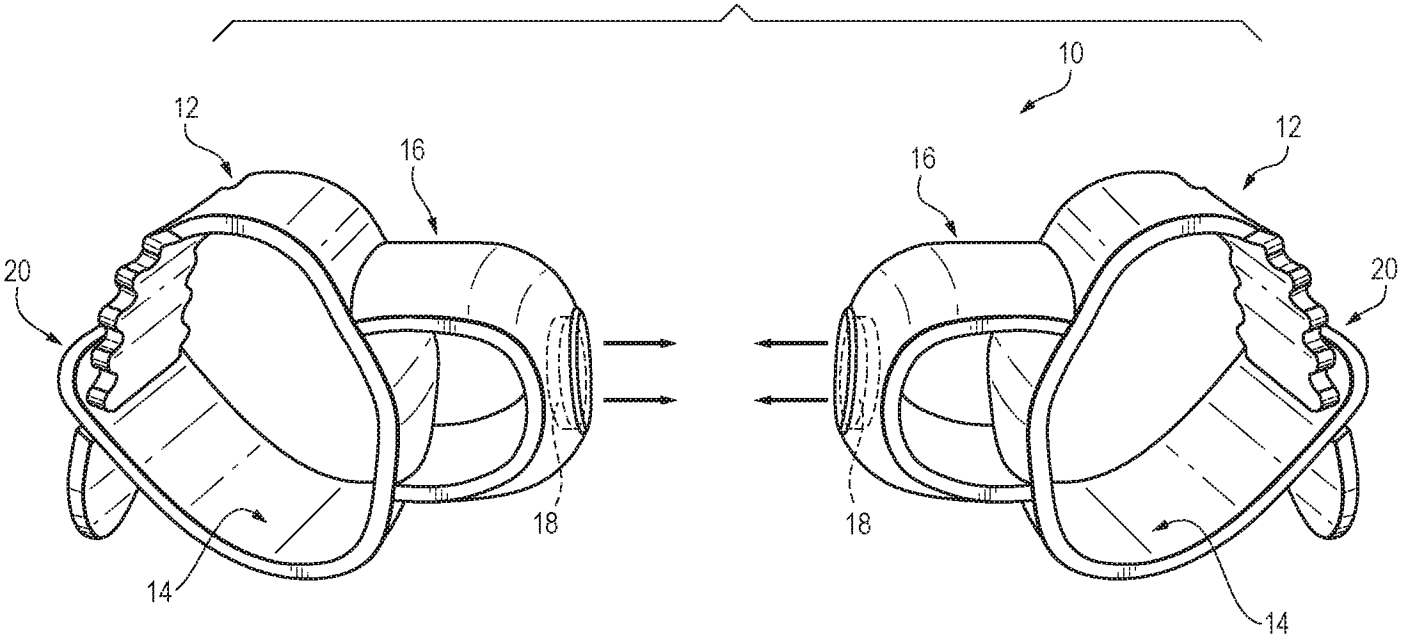
FIG. 3 is a perspective view of the device of FIG. 1 illustrating the location of magnets contained within each attractable wrist cuff in accordance with one embodiment of the present invention.
Figure 4:
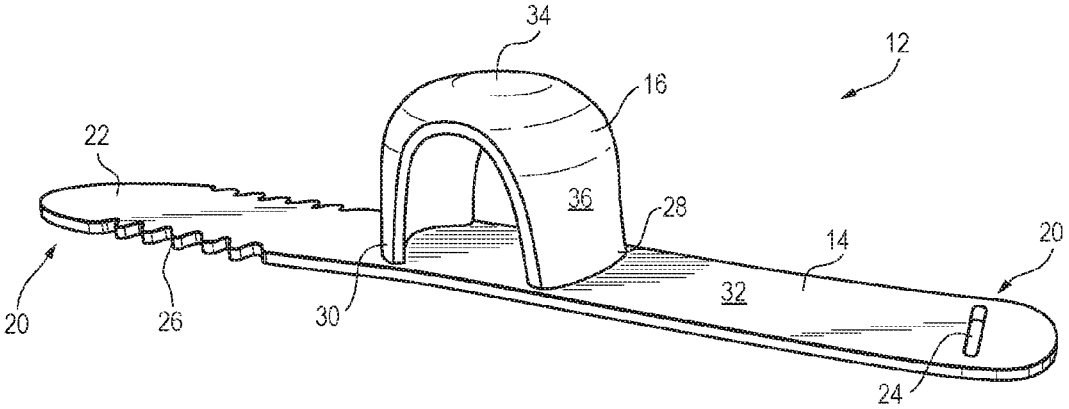
FIG. 4 is a perspective view of an attractable wrist cuff used in an athletic training device in accordance with one embodiment of the present invention.

Turning to FIGS. 1-3, device 10 can comprise two or more cuffs 12, each of which can be configured for securement around a user's wrists, arms, legs, etc. According to one embodiment of the present invention, each cuff 12 can include a flexible band 14 and a spacer component 16 extending from band 14. Contained within spacer component 16 can be a magnet 18 as illustrated in FIG. 3 by broken lines. As illustrated in FIG. 3, magnet 18 in each cuff 12 can enable cuffs 12 to be urged together (by the magnetic force of attraction) when cuffs 12 are placed in close proximity to one another and prevent the cuffs 12 from separating without applying a sufficient separating force. Alternatively, if desired, magnets 18 can be configured so that when cuffs 12 are placed in close proximity to one another, the magnetic force between the magnets 18 urges the cuffs 12 apart.

Figure 5:
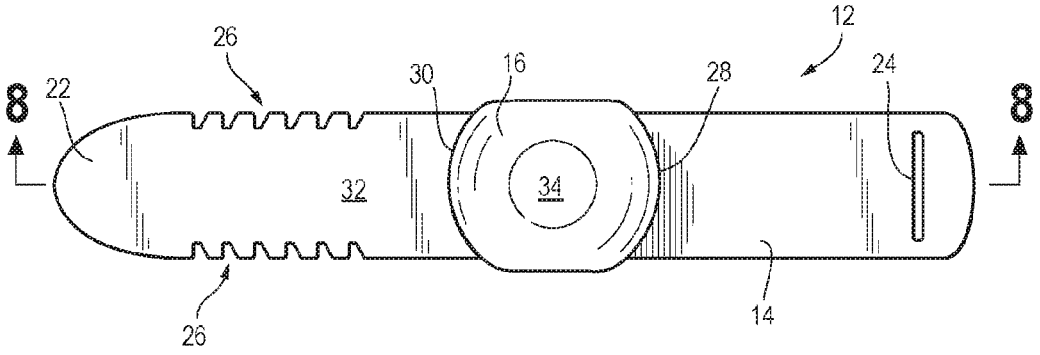
FIG. 5 is a top plan view the attractable wrist cuff of FIG. 4.
Figure 6:
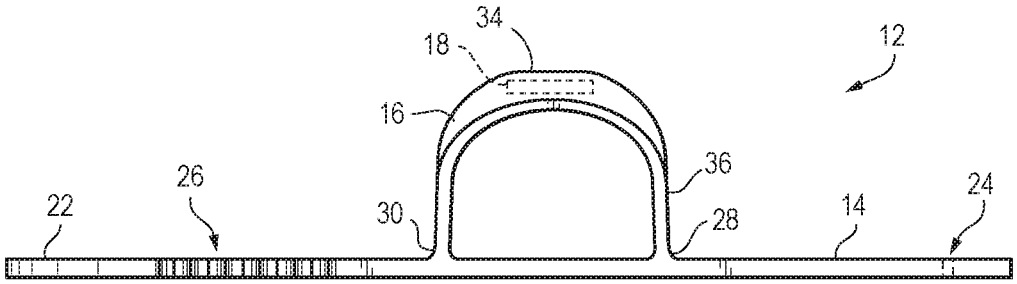
FIG. 6 is a side elevation view of the attractable wrist cuff of FIG. 4 illustrating the position of a magnet located in the attractable wrist cuff in accordance with one embodiment of the present invention.
Figure 7:
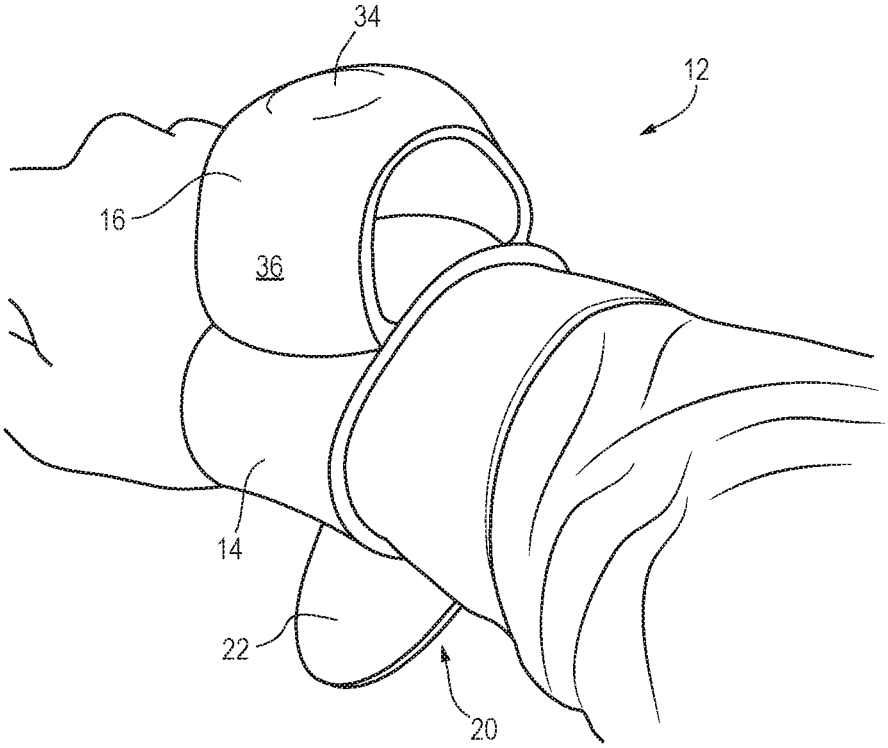
FIG. 7 is a perspective view of the attractable wrist cuff of FIG. 4 illustrating the attractable wrist cuff secured around a user's arm.

Turning to FIGS. 4-7, flexible band 14 of each cuff 12 can be sized, shaped and configured for wrapping around a user's wrists (or limb) and being secured into an enclosed loop (as illustrated in FIG. 7) by securement means 20 on band 14. Preferably, band 14 and securement means 20 are configured to allow a user to wrap band 14 around the user's arm, wrist, etc. and adjust the size of the opening created by band 14 so that band 14 is snuggly and securely positioned around the user's arms, wrist, etc. so that it does not inadvertently come off during use. According to one embodiment of the present invention, securement means 20 can comprise a tongue 22 located at one end of band 14 and a slot 24 located on the opposite end of band 14. As best shown in FIG. 5, tongue end 22 can include a plurality of sizing notches 26, which can allow a user to adjust the opening of the enclosed loop created by band 14 when placed around the user's wrist (or limb). Securement means 20 can also be configured as hook and loop fasteners (e.g., Velcro®), a buckle, clasp, clip, button, snap, or any other suitable securing structures for enclosing band 14 into an enclosed loop around a user's wrists, arms, legs or the like in alternative embodiments of the present invention. In another alternative embodiment (not shown), band 14 can be configured as a permanently enclosed loop where at least a portion of band 14 is an elastic material such that cuff 12 can be slid over the user's hand and onto the user's wrist or arm in a manner similar to a conventional athletic wristband. In such an embodiment, the elastic component or property of band 14 can operate as securement means 20.

Figure 10:
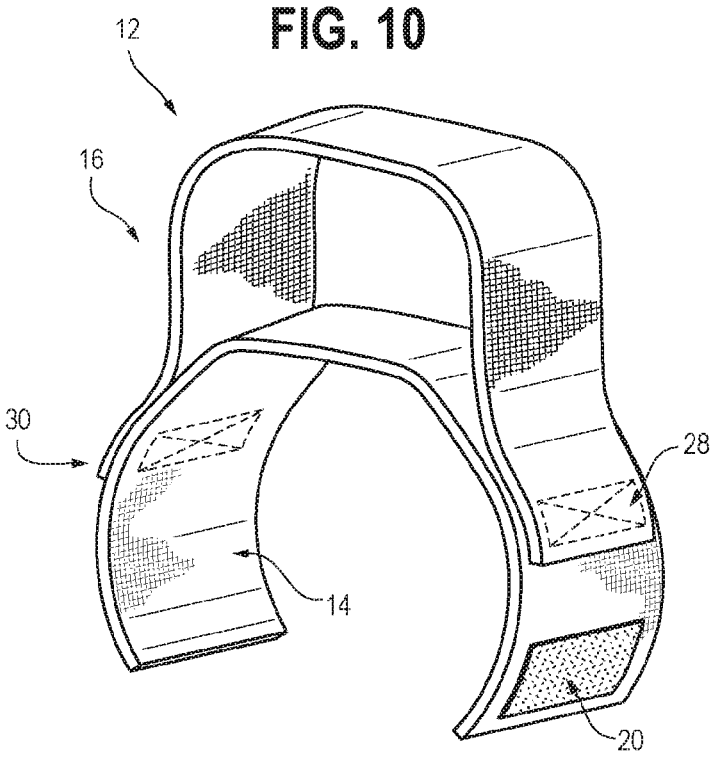
FIG. 10 is a perspective view of an attractable wrist cuff used in an athletic training device in accordance with a second embodiment of the present invention.
Figure 11:
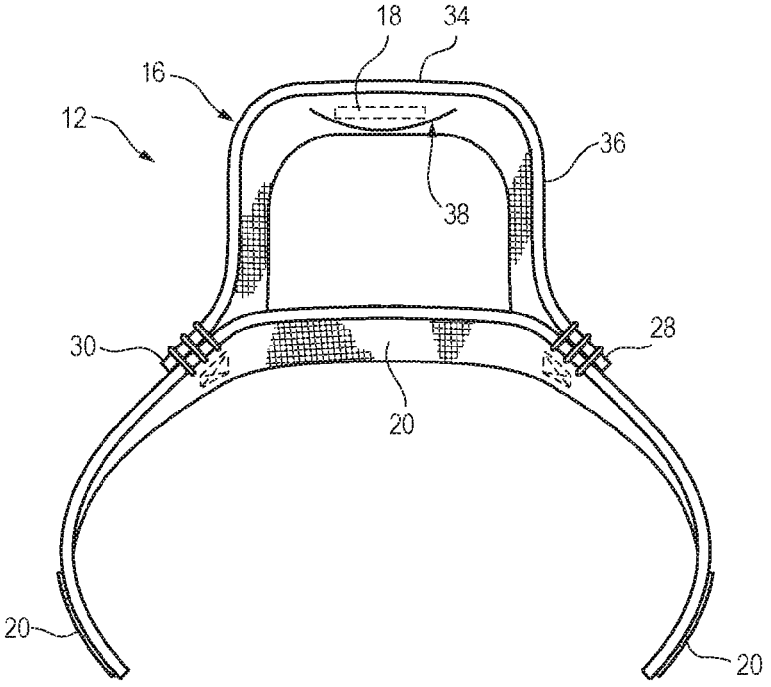
FIG. 11 is a side elevation view of the attractable wrist cuff of FIG. 10.

Cuffs 12 (and flexible bands 14) can be constructed from any number of different semi-flexible or pliable materials. According to one embodiment, as shown in FIGS. 1-7, cuffs 12 can be constructed from a silicone-based or polymer-based material. In such an embodiment, cuffs 12 can be sufficiently flexible to allow each cuff 12 to be wrapped around the user's arms but resilient and rigid enough to not tear, rip, or significantly stretch. In another embodiment, as shown in FIGS. 10 and 11 and described in greater detail below, cuffs 12 can be constructed from a fabric-based material incorporating nylon and/or spandex or similar material. Many other types of materials, such as leather, fabric and the like, can also be used in the construction of cuffs 12. The type of material used for cuffs 12 (and device 10 generally) can influence the dimensions of cuffs 12 as well as the rigidity and flexibility. For example, according to the embodiment shown in FIGS. 4-7, cuff 12 can have a width of approximately 1¾ inches and a thickness of approximately ⅛ inch. However, it is recognized that a wide range of dimensions are compatible with device 10 in alternative embodiments.

Connected to or extending from a generally central region of each cuff 12 can be spacer component 16, which can be configured for holding magnet 18 as described in greater detail below. As best shown in FIGS. 4-7, spacer component 16 can comprise a domed structure having two ends 28 and 30 connected to an outer surface 32 of band 14. In such an embodiment, spacer component 16 can be formed by a continuous strip of material having each end 28 and 30 connected to band outer surface 32 in a spaced apart configuration as shown in FIGS. 4-7. Component 16 can also be formed as a molded structure having a continuous sidewall. One advantage to connecting ends 28 and 30 to band 14 in a spaced apart configuration (or forming a continuous sidewall in a spaced relationship) is that can stabilize spacer component 16 and prevent the opposing free end of spacer component 16 from shifting or bending while device 10 is in use.

Spacer component 16 can be configured to extend away from band 14 and provide a space or gap between the user's wrists (or other portion of the user's arms or legs) and magnets 18 so that when the user places cuffs 12 together, both spacer components 16 do not require the user's wrists to be positioned immediately adjacent to one another. According to the embodiment shown in FIGS. 4-7, spacer component has a length of approximately two inches; however, a shorter or longer length can suitably be used in alternative embodiments.

Figure 18:
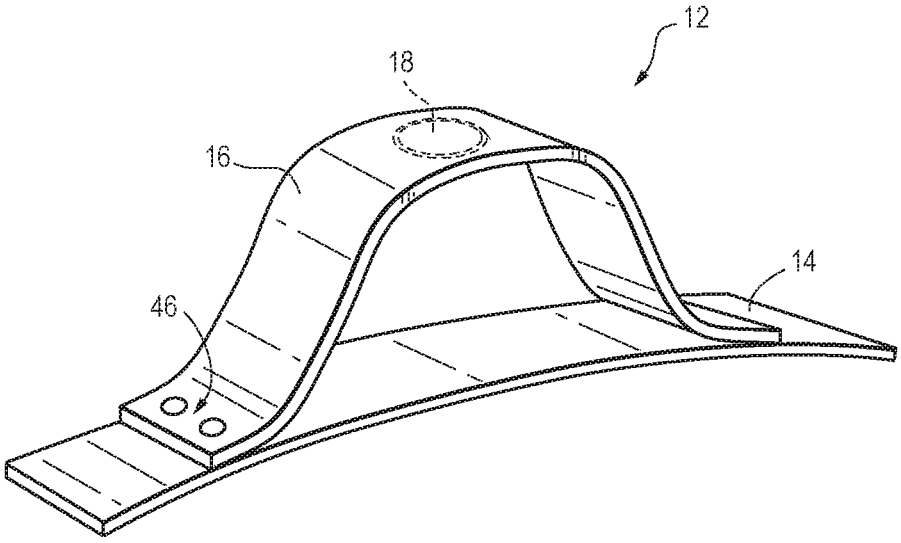
FIG. 18 is a partial perspective view of an attractable wrist cuff used in an athletic training device illustrating a spacer component of the cuff secured to a wrist band of the cuff in accordance with a one embodiment of the present invention.

Spacer component 16 can be integral with flexible band 14 such that spacer component 16 and band 14 are molded as a single piece, or spacer component 16 can be connected to band 14 through the use of an adhesive or heat sealing/welding technique. Spacer component 16 can also be connected to band 14 by sewing ends 28 and 30 of component 16 to band 14 in a fabric-based embodiment such as the embodiment shown in FIGS. 10 and 11. In yet another embodiment, spacer component 16 can be permanently or removably connected to band 14 by securing means 46, such as snaps, Velcro®, metal and/or plastic fasteners or the like as illustrated in FIG. 18.

As shown in FIG. 4-7, spacer component 16 can have a top wall 34 with a flattened region and a slightly rounded profile, and spacer component 16 can have an exterior sidewall 36 extending downwardly top wall 34 to ends 28 and 30. This configuration of spacer component 16 can provide for a more rigid, yet flexible and resilient structure increasing the performance of training device 10 as described in greater detail below. It is also recognized that spacer component 16 can have alternative configurations in alternative embodiments of the present invention, such as but not limited to the several embodiments shown in FIGS. 17-21. Sidewall 36 can be non-continuous as shown in FIGS. 4-7, which can allow access to the interior of spacer component 16; however, sidewall 36 can also be continuous and/or enclosed in alternative embodiments of the present invention.

One function of spacer component 16 is to provide separation between flexible band 14 and top wall segment 34/magnet 18 when band 14 is secured around the user's wrist. This function can allow device 10 to provide the sufficient space desired for proper positioning between the user's wrists when cuffs 12 are attached together via magnets 18.

Figure 8:
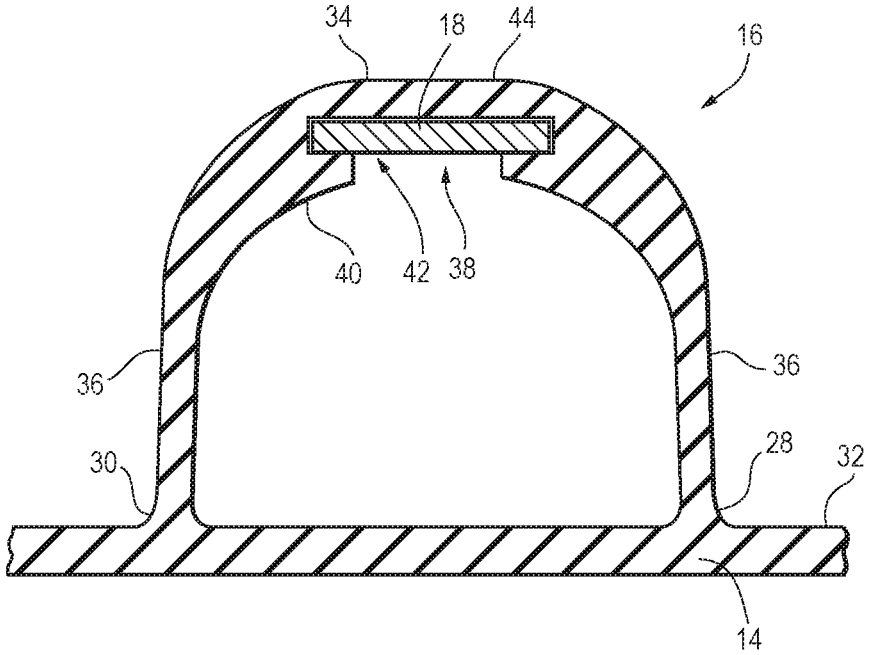
FIG. 8 is a partial section view of the attractable wrist cuff of FIG. 5 taken along section line 8-8.
Figure 9:
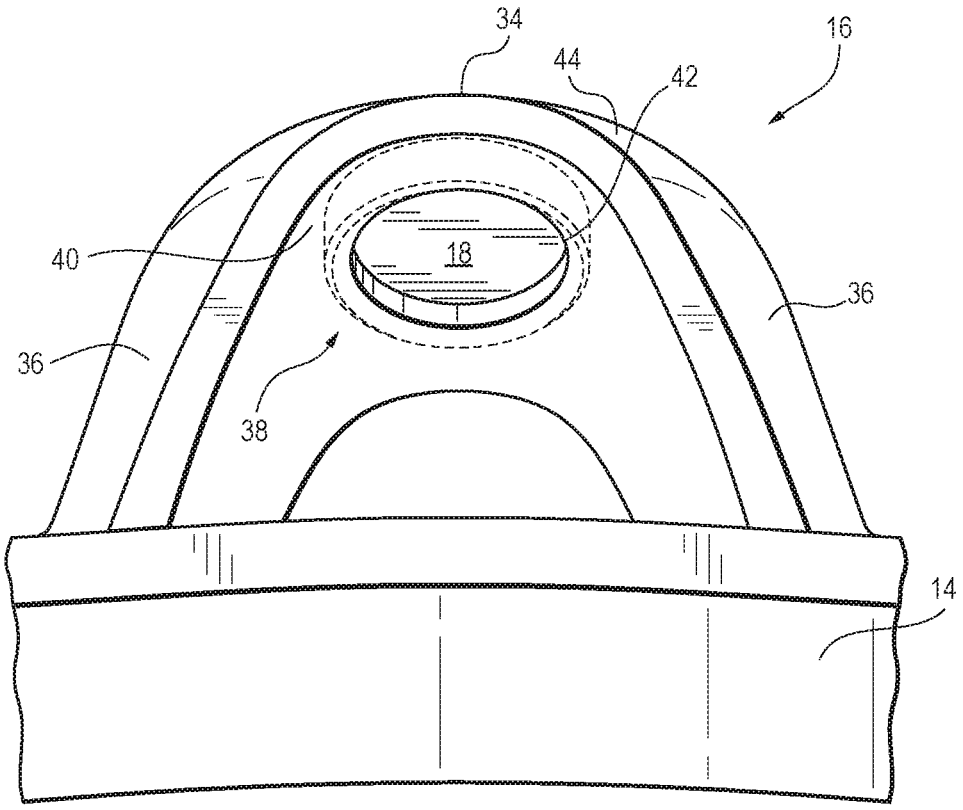
FIG. 9 is a partial perspective view of the attractable wrist cuff of FIG. 4 illustrating the position of a magnet located in the attractable wrist cuff.

Turning to FIGS. 8 and 9, top wall 34 can include a housing or pocket 38 configured to receive and hold magnet 18 against an interior surface 40 of top wall 34. Pocket 38 can have an opening 42 slightly smaller than the interior of pocket 38 so that magnet 18 can be inserted through opening 42 and retained within pocket 38, as best illustrated in FIG. 8. Opening 42 can also be in the form of a slit or slot (not shown) in the center region of pocket 38 so that magnet 18 can be inserted through opening 42 and span across the slot thereby holding magnet 18 in pocket 38. The resiliency and flexibility of the material used to construct spacer component 16 and pocket 38 can allow for it to be deformed in order to insert magnet 18 into pocket 38 and then form back into shape to retain magnet 18 within pocket 38. Magnet 18 can also be secured within pocket 38 through the use of adhesive or similar method in certain embodiments of the present invention. Pocket 38 can also be permanently enclosed or sealed to prevent magnet 18 from being removed. In alternative embodiments of the present invention, spacer component 16 can be constructed without a pocket 38 and magnet 18 can be secured directly to top wall 34 on its interior surface 40 (not shown), or on an exterior surface 44 of top wall 34 (not shown) using an adhesive or similar method. It is also recognized that pocket 38 can be positioned on the exterior surface 44 of top wall 34 in alternative embodiments of the present invention.

FIGS. 10 and 11 illustrate one embodiment of the present invention where wrist cuff 12 is constructed primarily from a fabric-based material. As best illustrated in FIG. 10, in such an embodiment, spacer component 16 can comprise a strip of fabric similar to flexible band 14. In addition, ends 28 and 30 of spacer component 16 can be secured to flexible band 14 in a spaced-apart manner by sewing ends 28 and 30 to band 14 or by using any other suitable means. As shown in FIG. 11, pocket 38 can be formed in the fabric of spacer component 16 and adapted for receiving magnet 18. As also shown in FIG. 11, pocket 38 can be fully enclosed to prevent removal of magnet 18. It is also recognized that in alternative embodiments; however, pocket 38 can be constructed so that magnet 18 is selectively removable from pocket 38.

Turning back to FIG. 8, magnet 18 can have a flattened disc-like shape and be configured for being retained within pocket 38. As shown in FIG. 8 and described above, magnet 18 can be slightly larger than opening 42 so that magnet 18 can be retained within pocket 38. Magnet 18 can have any number of different sizes and strengths depending on the particular embodiment of the present invention. Preferably, magnet 18 has a radius or length less than that of top wall 34 so that it can be easily received and retained within pocket 38. According to one embodiment, magnet 18 can be designed to be selectively removable from pocket 38 so that it can be interchanged with a different magnet 18 of greater or lesser strength. Such an embodiment can allow device 10 to be adaptable to several different users and purposes as well as allow for the replacement of ineffective magnets 18.

Figure 12:
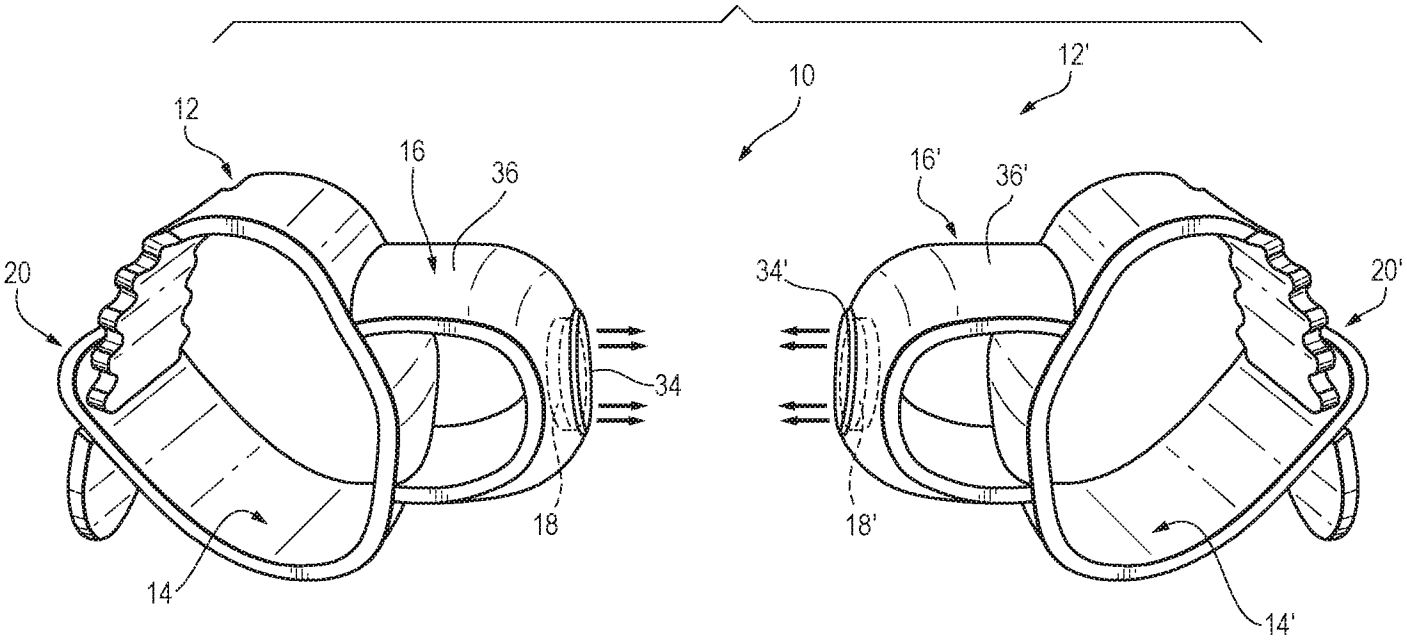
FIG. 12 is a schematic perspective view of an athletic training device having two attractable wrist cuffs in a separated position in accordance with one embodiment of the present invention.
Figure 13:
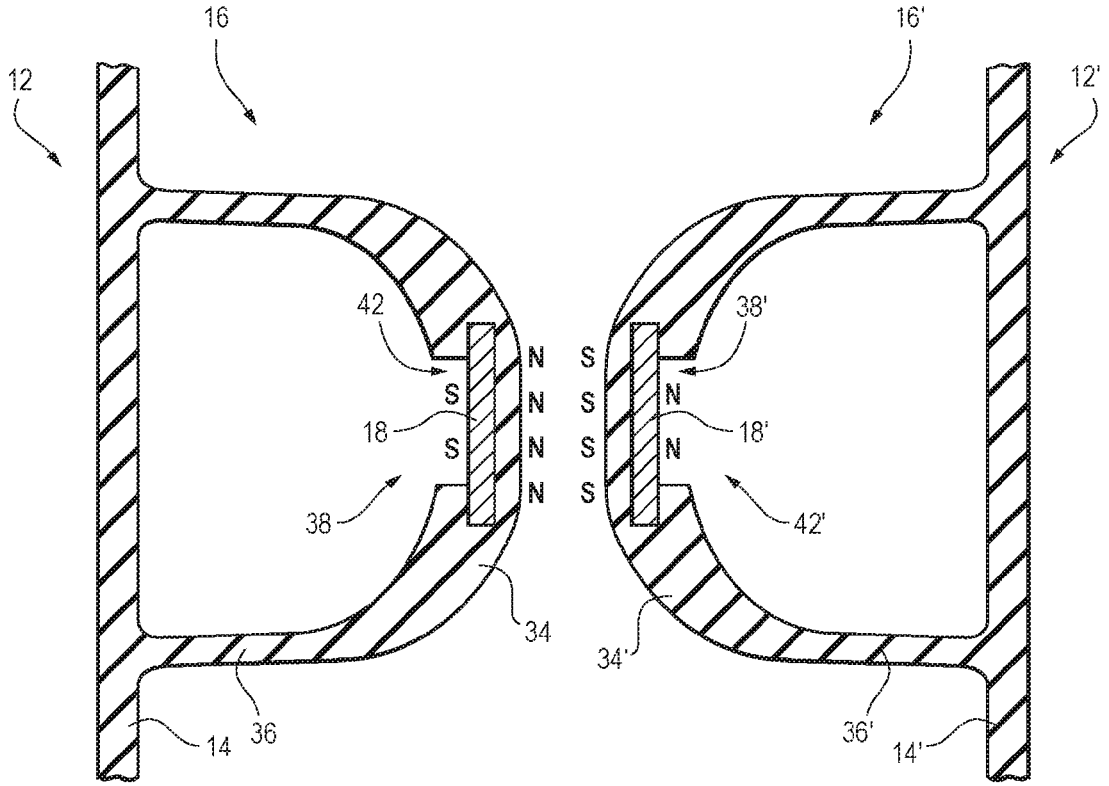
FIG. 13 is a partial schematic side view of the device of FIG. 12 illustrating the positioning of magnets located in each attractable wrist cuff in accordance with one embodiment of the present invention.

Turning to FIGS. 12 and 13, magnet 18 of each wrist cuff 12 is also preferably positioned and orientated in pocket 38 (or on top wall 34) so that the spacer component top wall exterior surfaces 44 of each cuff 12 is magnetically orientated toward one another. In other words, it is preferable that the polarity of the magnets 18 are arranged so that the magnets 18 urge the wrist cuffs 12 together at their respective spacer component top wall exterior surfaces 44 and prevent separation of surfaces 44 from one another unless a sufficient separating force is applied to overcome the attracting force of the magnets 18. FIGS. 12 and 13 illustrate device 10 according to one embodiment with two wrist cuffs 12 and 12' placed close together. In order for both wrist cuffs 12 and 12' to be attracted to one another by magnetic force, both cuffs 12 and 12' can be similarly designed and configured with the exception of the orientation of their respective magnets 18 and 18'. The proper magnetic orientation can be attained by placing magnet 18 of first wrist cuff 12 with an outward facing surface having a North magnetic pole and placing magnet 18' of second wrist cuff 12' with an outward facing surface having a South magnetic pole as best shown in FIG. 13. As a result, spacer components 16 and 16' of each wrist cuff 12 and 12', respectively, will be urged together when cuffs 12 and 12' are positioned closely adjacent to one another, and upon connection, will remain connected until a sufficient separating force is applied to overcome the force created by magnets 18.

Figure 14:
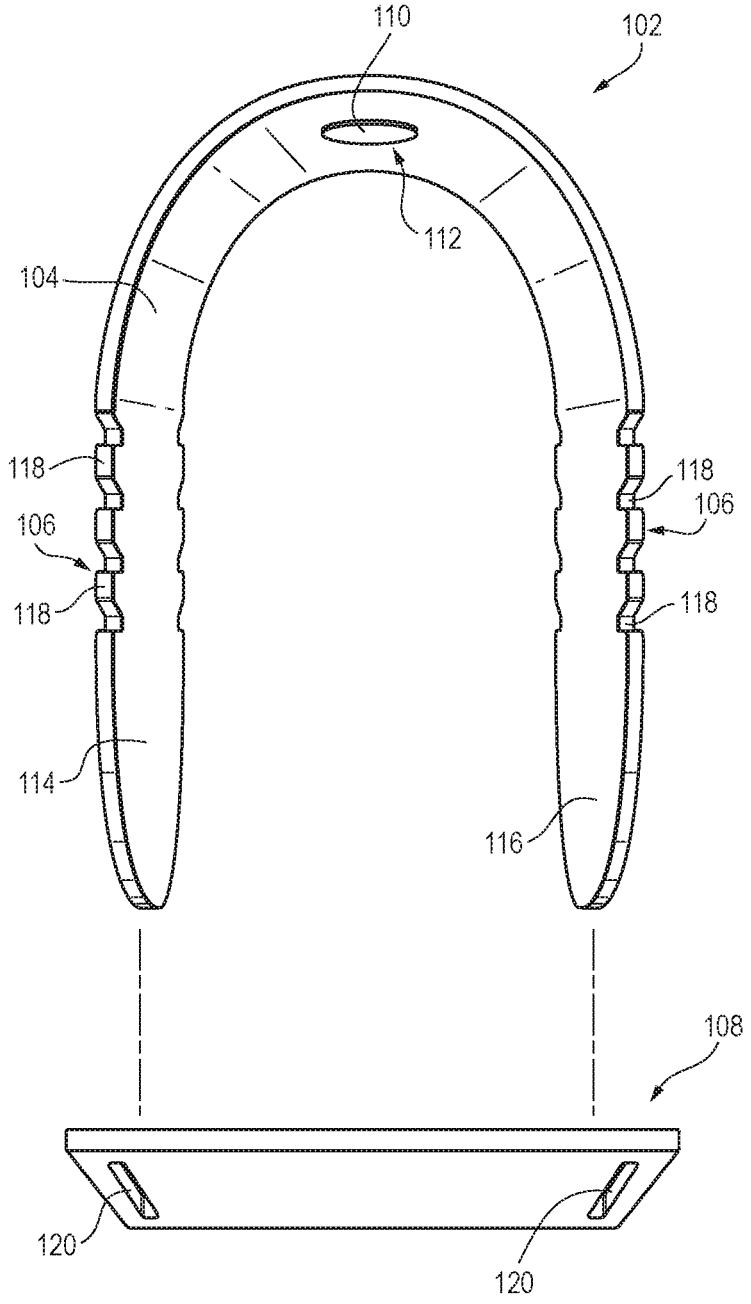
FIG. 14 is a perspective view of an attractable wrist cuff used in an athletic training device in accordance with a third embodiment of the present invention.
Figure 15:
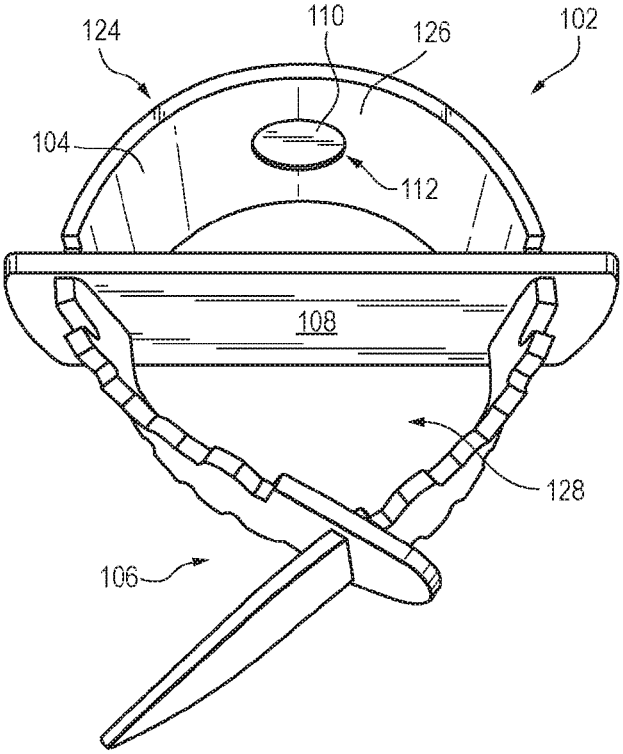
FIG. 15 is a perspective view of the attractable wrist cuff of FIG. 14.
Figure 16:
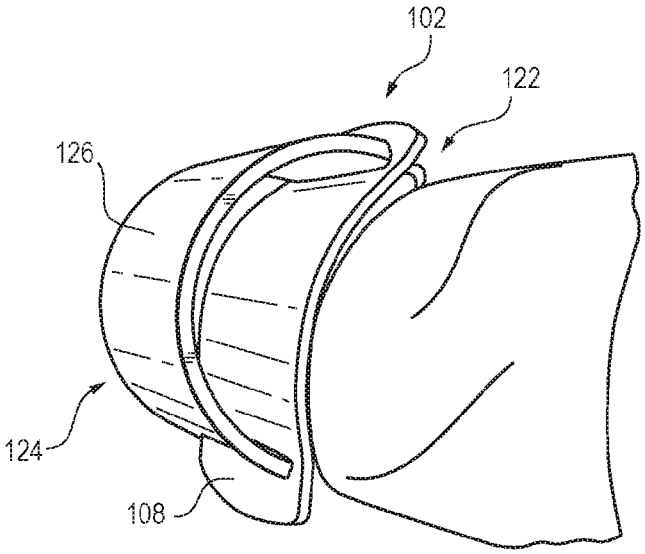
FIG. 16 is a perspective view of the attractable wrist cuff of FIG. 14 illustrating the wrist cuff secured to a user's arm.

FIGS. 14-16 illustrate another alternative embodiment of device 10. As best shown in FIGS. 14 and 15, device 10, according to such an embodiment, can comprise a pair of wrist cuffs 102, each having a flexible band 104 with band securement means 106 (identical to securement means 20 described above), a spacer 108, and a magnet 110. Each wrist cuff 102 can also include a housing or pocket 112 for holding magnet 110, as further shown in FIGS. 14 and 15. Flexible band 104 can be constructed as a strip of material having any suitable length, width and thickness. Preferably, flexible band 104 has a length suitable for being placed around a user's arm or wrist with enough space to allow for a portion of the band 104 to remain spaced away from the user's arm or wrist by the positioning of spacer 108 as illustrated in FIG. 16. In addition, similar to flexible band 14 in the previously described embodiment, flexible band 104 (and cuff 102) can be constructed of any suitable material with a desirable flexibility, rigidity, and resiliency, including but not limited to a silicone-based material, plastic or polymer-based material, and/or fabric-based material.

As best shown in FIG. 15, securement means 106 can be configured as any suitable means for removably attaching a first end 114 of band 104 to a second end 116 of band 104 as described above with respect to band securement means 20. Accordingly, such band securement means 106 can comprise a tongue and slot configuration, Velcro®, buckle, clasp, or other suitable means. Any other commonly known type of connecting means can alternatively be used. In addition, as previously described with respect to flexible band 14 and securement means 20, each flexible band 104 can be configured as a permanently enclosed loop with at least a portion of elastic material (which can constitute securement means 106) such that wrist cuff 102 can be slid over the user's and an onto the user's wrist, similar to a conventional athletic wrist band.

As illustrated in FIGS. 14 and 15, intermittently spaced along first end 114 and second end 116 of flexible band 104 can be a plurality of securing notches 118. Notches 118 can be configured for receiving and selectively holding spacer 108 as best shown in FIGS. 14 and 15. As shown, spacer 108 can be configured has a flexible, elongated plate that is sized to span across the width of a user's arm, wrist, leg, ankle, etc. While the figures illustrate spacer 108 with a reduced thickness, spacer 108 can be configured in alternative embodiments with an increased thickness, a more rounded shape, or other suitable structure that generally conforms to the user's limbs and maintains separation of a portion of the band 104 from the user's limb. Spacer 108 can be constructed of any flexible or semi-flexible material, including but not limited to silicone, polymer, plastic and the like. Each end of spacer 108 can include a slot 120 for receiving one end 114 or 116 of flexible band 104. The width and length of slots 120 can be configured allow band end 114 or 116 to be inserted through slot 120 and then retained between securing notches 118 as best shown in FIG. 14.

When securement means 106 are connected, as shown in FIGS. 15 and 16, wrist cuff 102 (and flexible band 104) can be separated by spacer 108 into a first section 122 and a second section 124, as also shown in FIGS. 15 and 16. Second section 124 can include magnet 110 and/or magnet housing 112 (as illustrated in FIG. 15) defined into a central region 126 of band 104 in a manner similar to magnet 18 and magnet pocket 38 described in the previous embodiments of device 10. Wrist cuffs 102 can be used by placing first section 122 around a user's arm/wrist and connecting securement means 116. Spacer 108 can flex or bend to generally conform to the curvature of the user's arm or wrist, as best shown in FIG. 16, and can keep second section 124 spaced apart from first section 122 and the user's arm/wrist similar to spacer component 16 described in the previous embodiments.

Device 10 can be used by placing one wrist cuff 12 (or 102) on each arm or limb of the user (or other object) and securing flexible bands 14 (or 104) of each wrist cuff 12 around each arm using securement means 20. Cuffs 12 can be positioned on the user's wrists so that spacer components 16 (or 106) and magnets 18 (or 110) are orientated as desired by the user. Once secured around the user's arms, device 10 can operate to selectively urge the user's arms in close proximity to one another when the user's arms (and cuffs 12 or 102) are positioned closely adjacent to one another. When the user's arms (and thus wrist cuffs 12) are moved close together, the magnetic force of attraction between magnets 18 and 18' urges the user's arms closer together until spacer component 16 of the first wrist cuff 12 contacts spacer component 16' of second wrist cuff 12' at top wall 34, as best shown in FIGS. 2, 12 and 13. Further, the magnetic force of attraction between magnets 18 and 18' then holds wrist cuffs 12 of device 10 together until the user applies sufficient force by urging his or her arms apart to overcome the force of the magnets 18 and 18'.

Thus, when a user positions cuffs 12 far apart, such as when the user's arms are separated, the magnetic force between magnets 18 and 18' do not place any restriction the user's movements. However, as user positions the cuffs 12 closer together, the magnetic force between magnets 18 and 18' begin to affect the user's movement by urging the magnets 18 and 18' (and therefore cuffs 12) together. Finally, as the cuffs 12 are positioned within close proximity to one another, the magnetic force between magnets 18 and 18' forces cuffs 12 together until they contact one another. As a result, the objects which the cuffs 12 are secured to, such as the user's wrists for example, are positioned in a spaced relationship defined by the spacer components 16 of cuffs 12, and can only be separated by applying a force greater than the magnetic force of attraction between magnets 18 and 18'.

The inclusion of magnets 18 and 18' in device 10 (and the resulting magnetic forces created between magnets 18 and 18') can enable the user to continuously use device 10 while performing the various athletic training exercises without having to stop to adjust or reconfigure device 10. For example, when used as a training device for training proper hand position when fielding a groundball, device 10 can reinforce the close positioning of the user's throwing hand relative to the user's glove and then allow the user to separate his or her hands (such as to throw the ball after fielding the groundball) without having to make adjustments to device 10. This can enable the user to perform multiple repetitions of the desired athletic activity without being obstructed by device 10.

Magnets 18 and 18' additionally allow device 10 to selectively bind cuffs 12 and 12' together and prevent the inadvertent or unintentional separation of the user's hands and wrists. Accordingly, device 10 can allow cuffs 12 and 12' to be separated only when desired by the user (as opposed to inadvertently) by applying the sufficient separating force to oppose the force created by magnets 18 and 18'. For example, when device 10 is used as a training device and cuffs 12 are placed around a user's wrists, device 10 urges the user's wrists together when placed in close proximity to one another and prevents separation of cuffs 12 and 12' until deliberate force to separate cuffs 12 and 12' is applied. Thus, the device 10 can function to make the user more aware of the positioning of the user's hands, wrists, etc.

Figure 17A:
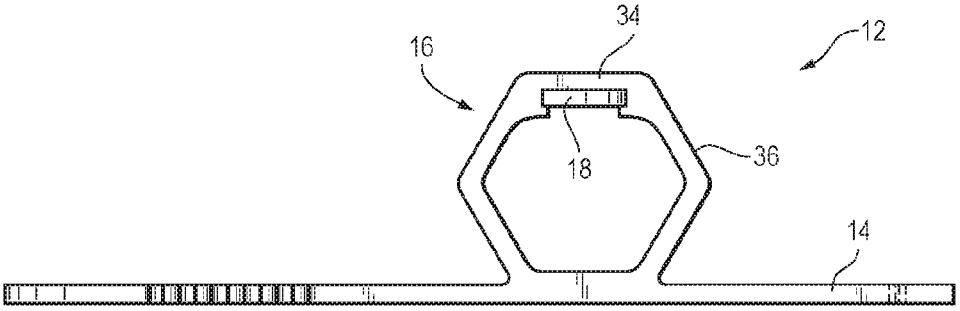
FIG. 17A is a schematic side view an attractable wrist cuff used in an athletic training device in accordance with one embodiment of the present invention.
Figure 17B:
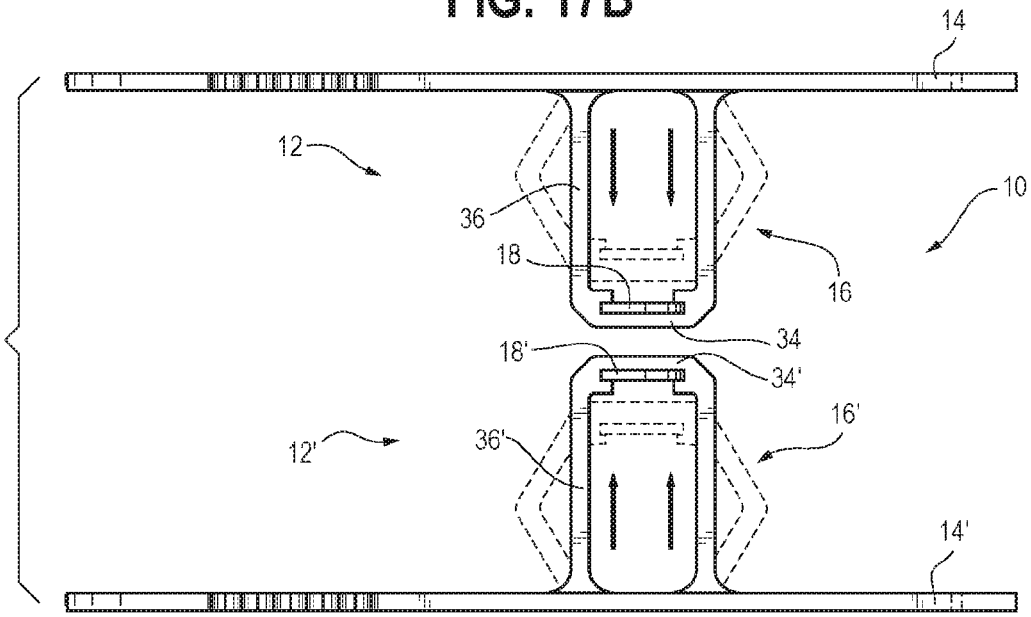
FIG. 17B is a schematic side view of the device of FIG. 17A illustrating a stretched position of the attractable wrist cuff in accordance with one embodiment of the present invention.

As best shown in FIGS. 17A and 17B, cuffs 12 can be configured so that spacer components 16 have slightly flexible and resilient characteristics when cuffs 12 are connected together by the magnetic force of magnets 18 and 18'. In such an embodiment, as the user begins to move his or her arms or wrists or legs apart in order to overcome the magnetic force of magnets 18 and 18', spacer components 16 and 16' of each cuff 12 and 12' can slightly flex or stretch in a resilient manner until spacer components 16 and 16' of cuffs 12 and 12' are separated from one another. Once spacer components 16 and 16' are separated and the user is free from the magnetic force applied between magnets 18 and 18', spacer components 16 and 16' can flex back into their original shape.

Figure 19:
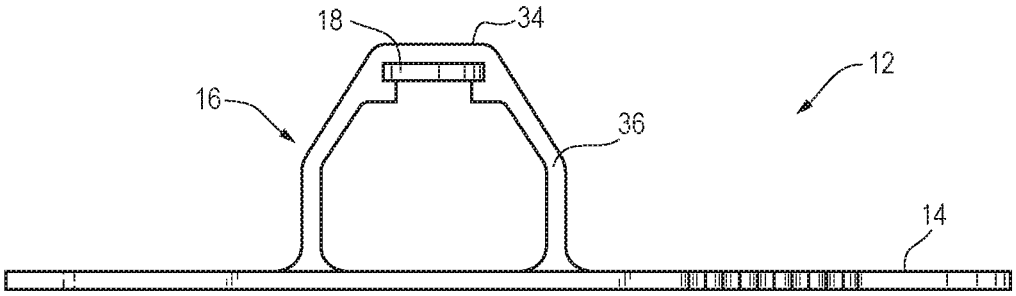
FIG. 19 is a schematic side view of an attractable wrist cuff used in an athletic training device illustrating an alternative configuration of a spacer component in accordance with one embodiment of the present invention.
Figure 20:
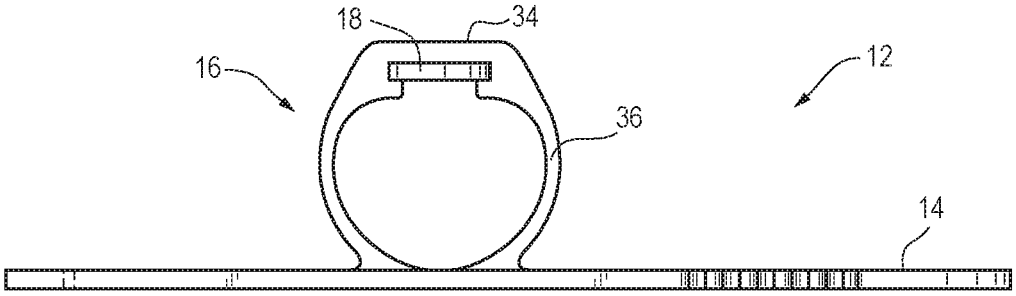
FIG. 20 is a schematic side view of an attractable wrist cuff used in an athletic training device illustrating an alternative configuration of a spacer component in accordance with one embodiment of the present invention.
Figure 21:
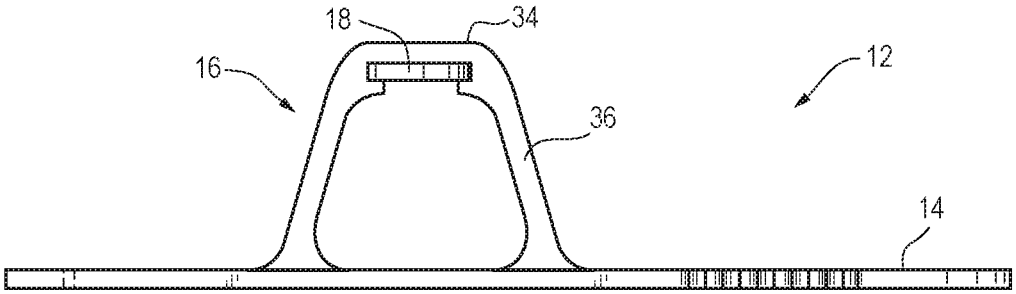
FIG. 21 is a schematic side view of an attractable wrist cuff used in an athletic training device illustrating an alternative configuration of a spacer component in accordance with one embodiment of the present invention.

The figures illustrate several different alternative embodiments of the present invention. While each of these embodiments illustrates different configurations and components, it is considered within the scope of the present invention to incorporate and/or combine various features of each embodiment into further alternative embodiments. The figures also show embodiments with certain sizes or dimensions. However, it is also considered within the scope of the present invention to utilize any number of different dimensions and/or proportions depending on the particular embodiment of the present invention. FIG. 18 illustrates one embodiment of the present invention where flexible band 14 comprises an elastic material and spacer component 16 comprises a silicone material. As illustrated in FIG. 18, snaps or other suitable connecting means 46 can be used to secure spacer component 16 to band 14 in such an embodiment. FIG. 19 illustrates another embodiment where sidewall 36 of spacer component 16 includes a generally straight portion and an angled portion. FIG. 20 illustrates another embodiment where spacer component 16 has a generally rounded sidewall 36 and a flattened top wall 34. FIG. 21 illustrates another embodiment where spacer component 16 has an angled sidewall 36 and a rounded yet flattened top wall 34.

The configuration of device 10 can allow it to be used as a training device where it is desirable to selectively maintain a user's arms in close proximity. For example, one particularly advantageous use of device 10 can be as a fielding training aid for baseball and softball. It is well known that when fielding a ground ball, a fielder is often taught to place his or her throwing hand next to and above the opening of the glove in order to both assist in corralling the ball as it enters the glove and to allow for faster transfer from the glove to the throwing hand after the ball is fielded. However, it is also well known that this positioning of the hand can be difficult, especially for younger players, to consistently maintain. Device 10 can be used as a training aid to train players to place their throwing hand adjacent to their glove when fielding a ground ball. Specifically, fielders are typically taught to position their throwing hand just above their glove when fielding the ball. Accordingly, device 10 can be used to train and assist in maintaining this proper hand positioning by placing cuff 12 on the fielder's throwing hand with spacer component 16 (and thus magnet 18) extending inward from the fielder's throwing-hand wrist and by placing cuff 12' on the fielder's glove hand with spacer component 16' (and thus magnet 18') extending inward from the fielder's glove-hand wrist. When used in this manner, magnets 18 and 18' help urge a fielder's wrists together through the magnet's magnetic force of attraction, yet spacer components 16 and 16' can be configured to proper spacing of the fielder's hands, thereby placing the fielder's hands in the optimal position. Device 10 (through magnets 18 and 18') further prevents the fielder from separating his or her hands unintentionally or inadvertently until deliberate force is applied to overcome the magnetic force of attraction. The selective detachment and reattachment of wrist cuffs 12 of device 10 allows the user to use device 10 as a training aid with minimal disruption by allowing the user, for example, to separate his or her arms to throw a baseball or softball and then reconnect his or her alms to practice fielding another ground ball.

While the foregoing example illustrates device 10 being used as a training device for baseball and softball, it is recognized that device 10 can be used equally advantageously as a training device for other sports, such a football, basketball, golf, etc. For example, training device 10 can be used for teaching a user to catch a ball with two hands, maintain a two-handed swing, and many other advantageous sports-related movements. Further, device 10 can also be advantageously used for non-athletic or training orientated applications as well.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The teens "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. An athletic training device for assisting a user in selectively maintaining said user's arms or legs in close proximity to one another, said device comprising:

a set of removable cuffs configured for placement around said user's arms or legs, wherein each of said removable cuffs comprises:

a flexible band configured for wrapping around one of said user's arms or legs;

a spacer component connected to and extending from said flexible band, said spacer component including a top wall segment and a pocket defined into said top wall segment, wherein said pocket has a pocket opening that provides access to said pocket; and a magnet located within said pocket of said spacer component, wherein said pocket opening has a diameter less than a diameter of said magnet and said magnet is selectively removable from said pocket through said pocket opening;

wherein said magnets are orientated with opposing polarity to create an attracting magnetic force between said spacer component of said cuffs when said user is wearing said cuffs and said user's arms or legs are positioned in close proximity to one another; and wherein said attracting force causes said spacer components of said cuffs to connect together and remain connected unless a separating force greater than said attracting magnetic force is applied to said cuffs.

2. The device of claim 1, wherein said spacer component further comprises a sidewall segment extending between said top wall segment and said flexible band, and wherein said sidewall segment includes an opening for providing access to an interior side of said top wall section.

3. The device of claim 2, wherein said sidewall segment includes a rounded section where said sidewall segment connects to said top wall segment.

4. The device of claim 2, wherein said pocket opening is defined into said interior side of said top wall segment.

5. The device of claim 1, wherein said flexible band includes securement means for securing said cuff in an enclosed loop around one of said user's arms or legs.

6. The device of claim 1, wherein said cuffs are constructed from a silicone-based material.

7. The device of claim 1, wherein said spacer component includes a sidewall segment extending between said top wall segment and said flexible band, and wherein said sidewall segment includes an outward angled section and an inward angled section.

8. The device of claim 7, wherein said outward and said inward angled sections of said sidewall segments enable said sidewall segments of said spacer components to resiliently elongate when said spacer components are connected together and said separating force is applied to said cuffs.

9. An athletic training device for assisting a user in selectively maintaining said user's arms or legs in close proximity to one another, said device comprising:

a set of removable cuffs configured for placement around said user's arms or legs, wherein each of said removable cuffs comprises:

a flexible band configured for wrapping around an arm or leg of said user, said flexible band including a first end with a plurality of notches and a second end with a plurality of notches;

a spacer component removably connectable to said flexible band, said spacer component including a first slot for receiving said first end of said flexible band and a second slot for receiving said second end of said flexible band; and a magnet secured to a central region of said flexible band;

wherein said spacer component is configured for being selectively retained between said plurality of notches on said first and said second ends of said flexible band to divide said cuff into a first section and a second section;

wherein said second section is configured for being secured around one of said user's arms or legs;

wherein said magnets are orientated with opposing polarity to create an attracting magnetic force between said first section of said cuffs when said user is wearing said cuffs and said user's arms or legs are positioned in close proximity to one another; and wherein said attracting force causes said first sections of said cuffs to connect together and remain connected unless a separating force greater than said attracting magnetic force is applied to said cuffs.

10. The device of claim 9, further comprising a magnet pocket defined into said flexible band at said central region, wherein said magnet pocket is configured for securing said magnet to said flexible band.

11. The device of claim 10, wherein said second end of said flexible band includes a slot configured for receiving said first end of said flexible band and securing said second section of said second section of said cuff around said user's arm or leg.

12. A baseball training device for assisting a user in keeping said user's throwing hand adjacent to said user's glove hand, said device comprising:

a pair of wrist cuffs each comprising:

a flexible band configured for being secured around a wrist of said user;

a spacer component extending from said flexible band, said spacer component including a sidewall segment extending from said flexible band and a top wall segment spanning across said sidewall segment;

a magnet secured within said top wall segment of said spacer component;

a pocket defined within said top wall segment, said pocket being configured for holding said magnet; and a pocket opening provided on an interior side of said top wall segment and configured to provide access to said pocket, wherein said pocket opening has a diameter less than a diameter of said magnet;

wherein said magnet is selectively removable from said pocket through said pocket opening;

wherein said magnets are polarized and orientated to attract said wrist cuffs together when said user places said throwing hand in close proximity to said user's glove hand.

13. The device of claim 12, wherein said flexible band of each of said wrist cuffs includes a first end having a plurality of notches and a second end having a slot defined therethrough, said slot sized to receive said first end and secure said flexible band into an enclosed loop around said user's wrist.

14. The device of claim 12, wherein said magnet of each wrist cuff is positioned within said spacer component so that said magnet remains spaced away from said user's wrist when said wrist cuff is secured to said user's wrist.

* * * * *